US009347624B2

(12) United States Patent
Ko et al.

(10) Patent No.: US 9,347,624 B2
(45) Date of Patent: May 24, 2016

(54) LIGHTING APPARATUS HAVING IMPROVED LIGHT OUTPUT UNIFORMITY AND THERMAL DISSIPATION

(71) Applicant: TSMC Solid State Lighting Ltd., Hsinchu (TW)

(72) Inventors: Pei-Wen Ko, Zhubei (TW); Wei-Yu Yeh, Tainan (TW)

(73) Assignee: EPISTAR CORPORATION, Hsinchu (TW)

( * ) Notice: Subject to any disclaimer, the term of this patent is extended or adjusted under 35 U.S.C. 154(b) by 0 days.

(21) Appl. No.: 14/598,282

(22) Filed: Jan. 16, 2015

(65) Prior Publication Data

US 2015/0124448 A1 May 7, 2015

Related U.S. Application Data

(63) Continuation of application No. 13/293,272, filed on Nov. 10, 2011, now Pat. No. 8,939,611.

(51) Int. Cl.

| | |
|---|---|
| ***F21V 13/02*** | (2006.01) |
| ***F21S 6/00*** | (2006.01) |
| ***F21V 17/12*** | (2006.01) |
| ***F21K 99/00*** | (2016.01) |
| ***F21V 29/70*** | (2015.01) |
| *F21Y 101/02* | (2006.01) |
| *F21V 29/76* | (2015.01) |
| *F21V 29/50* | (2015.01) |

(52) U.S. Cl.

CPC . *F21K 9/54* (2013.01); *F21V 13/02* (2013.01); *F21V 29/70* (2015.01); *F21S 6/00* (2013.01); *F21V 17/12* (2013.01); *F21V 29/50* (2015.01); *F21V 29/763* (2015.01); *F21Y 2101/02* (2013.01)

(58) Field of Classification Search

CPC ..... F21K 9/54; F21S 6/00; F21V 13/02; F21V 17/12; F21V 29/50; F21V 29/70; F21V 29/763; F21Y 2101/02

See application file for complete search history.

(56) References Cited

U.S. PATENT DOCUMENTS

| | | | | |
|---|---|---|---|---|
| 7,659,551 | B2 * | 2/2010 | Loh | H01L 33/58 257/415 |
| 8,939,611 | B2 * | 1/2015 | Ko | F21V 13/02 362/249.02 |
| 2006/0292747 | A1 * | 12/2006 | Loh | H01L 33/64 438/116 |
| 2013/0039070 | A1 | 2/2013 | Mathieu | |

* cited by examiner

*Primary Examiner* — Stephen F Husar

(74) *Attorney, Agent, or Firm* — Muncy, Geissler, Olds & Lowe, P.C.

(57) ABSTRACT

The present disclosure involves a lighting apparatus. The lighting apparatus includes a photonic device that generates light. The lighting apparatus includes a printed circuit board (PCB) on which the photonic device is located. The lighting apparatus includes a diffuser cap having a curved profile covering the PCB and the photonic device. The diffuser cap has a textured surface for scattering light generated by the photonic device. The lighting apparatus includes a thermally conductive cup that surrounds the diffuser cap and thermal conductively coupled to the PCB. The cup has a reflective inner surface that reflects light transmitting through the diffuser cap. The lighting apparatus includes a heat dissipation structure for dissipating heat generated by the photonic device. The heat dissipation structure is thermally coupled to the cup.

17 Claims, 5 Drawing Sheets

LIGHTING APPARATUS HAVING IMPROVED LIGHT OUTPUT UNIFORMITY AND THERMAL DISSIPATION

PRIORITY DATA

The present application is a continuation of U.S. patent application Ser. No. 13/293,272, filed on Nov. 10, 2011, now U.S. Pat. No. 8,939,611 issued Jan. 27, 2015, the disclosure of which is hereby incorporated by reference in its entirety.

TECHNICAL FIELD

The present disclosure relates generally to lighting instruments, and more particularly, to a lighting instrument using one or more semiconductor photonic devices as a light source.

BACKGROUND

The semiconductor integrated circuit (IC) industry has experienced rapid growth in recent years. Technological advances in IC materials and design have produced various types of ICs that serve different purposes. One type of these ICs includes photonic devices, such as light-emitting diode (LED) devices. An LED device, as used herein, is a semiconductor light source for generating a light at a specified wavelength or a range of wavelengths. LED devices are traditionally used for indicator lamps, and are increasingly used for displays. An LED device emits light when a voltage is applied across a p-n junction formed by oppositely doped semiconductor compound layers. Different wavelengths of light can be generated using different materials by varying the bandgaps of the semiconductor layers and by fabricating an active layer within the p-n junction.

Traditionally, LEDs are made by growing a plurality of light-emitting structures on a growth substrate. The light-emitting structures along with the underlying growth substrate are separated into individual LED dies. At some point before or after the separation, electrodes or conductive pads are added to the each of the LED dies to allow the conduction of electricity across the structure. LED dies are packaged by adding a package substrate, optional phosphor material, and optics such as lens and reflectors to become an optical emitter. However, conventional optics designs have not been optimized with respect to output light uniformity or heat dissipation.

Therefore, while existing methods of manufacturing LED devices have been generally adequate for their intended purposes, they have not been entirely satisfactory in every aspect. LED optics designs that have better light output and heat dissipation characteristics continue to be sought.

BRIEF DESCRIPTION OF THE DRAWINGS

Aspects of the present disclosure are best understood from the following detailed description when read with the accompanying figures. It is emphasized that, in accordance with the standard practice in the industry, various features are not necessarily drawn to scale or according to the exact geometries. In fact, the dimensions of the various features may be arbitrarily increased or reduced for clarity of discussion.

SUMMARY

Figure 1:
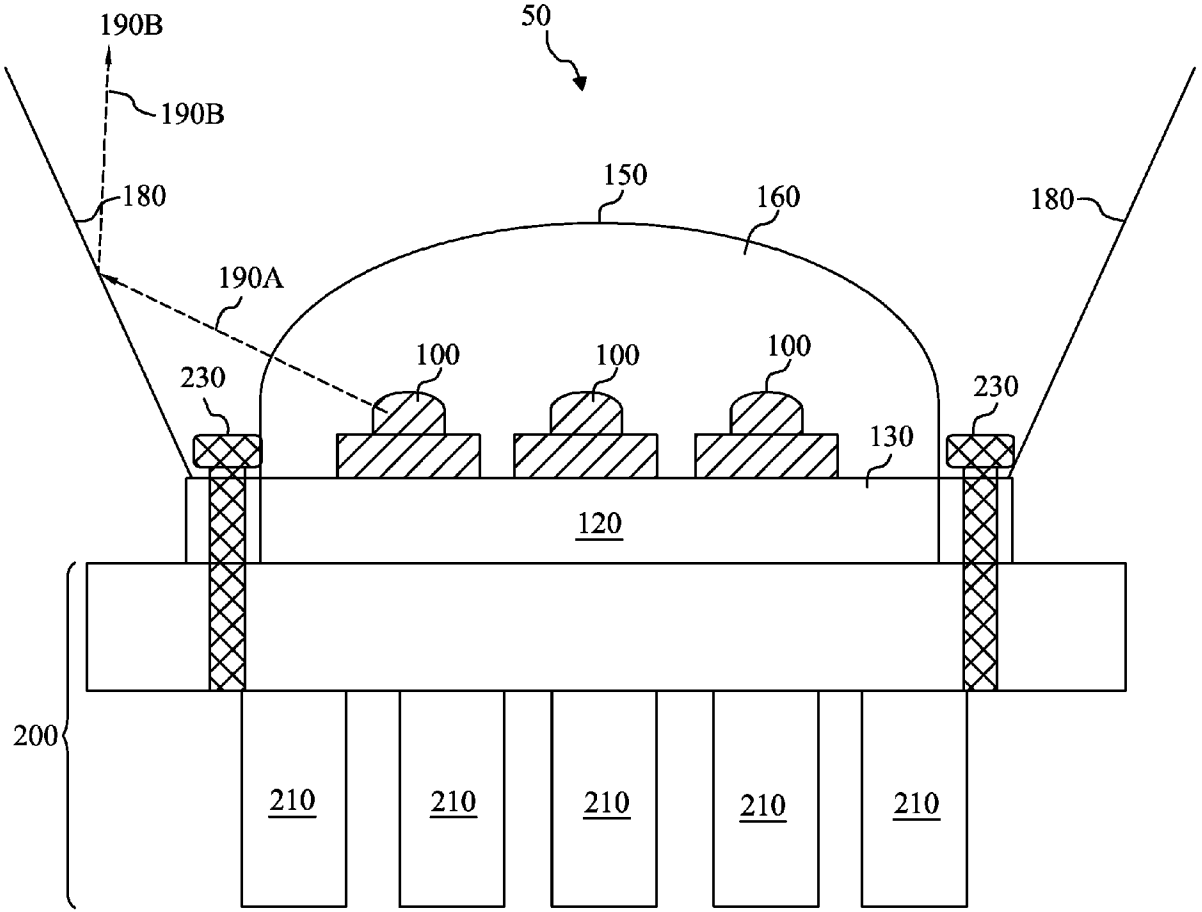
FIG. 1 is a diagrammatic fragmentary cross-sectional side view of an example lighting apparatus using a semiconductor photonic device as a light source according to various aspects of the present disclosure.

One of the broader forms of the present disclosure involves an apparatus. The apparatus includes: a light-emitting package that includes a light-emitting device sealed inside a diffuser cap and a substrate; a reflective structure located outside the light-emitting package and thermal-conductively coupled to the light-emitting package, wherein the reflective structure surrounds the light-emitting package, is operable to reflect light radiated by the light-emitting package, and is operable to thermally dissipate heat generated by the light-emitting package.

In some embodiments, the diffuser cap has a textured surface.

In some embodiments, the cap has a curved shape.

In some embodiments, the light-emitting device is located over the substrate; and a surface of the substrate over which the light-emitting device is located is operable to reflect light.

In some embodiments, the substrate includes a printed circuit board (PCB).

In some embodiments, the reflective structure circumferentially encircles the light-emitting package.

In some embodiments, the reflective structure includes a reflector cup having a sloped sidewall profile.

In some embodiments, the apparatus further comprises a thermal dissipation structure thermally coupled to the substrate.

In some embodiments, the thermal dissipation structure includes a board and a plurality of fins attached to the board; and the substrate is located on the board.

In some embodiments, the light-emitting device includes one or more light-emitting diodes.

In some embodiments, the apparatus includes a down light lighting module, and wherein the light-emitting package, the reflective structure, and the thermal dissipation structure are integrated within the down light lighting module.

Another one of the broader forms of the present disclosure involves a lamp. The lamp includes: one or more light-emitting devices disposed on a thermally conductive board; a non-flat diffuser cap disposed on the thermally conductive board, the diffuser cap housing the one or more light-emitting devices therein; a thermally conductive reflector cup surrounding the diffuser cap and the one or more light-emitting devices, the reflector cup being operable to reflect a portion of light propagating through the diffuser cap, the reflector cup being thermally coupled to the thermally conductive board; and a heat sink disposed below the thermally conductive board, the heat sink being thermally coupled to the thermally conductive board.

In some embodiments, the light-emitting devices include light-emitting diodes; and the thermally conductive board is a printed circuit board (PCB).

In some embodiments, the diffuser cap includes a roughened surface.

In some embodiments, the reflector cup is taller than the diffuser cap.

In some embodiments, a surface of the thermally conductive board on which the one or more light-emitting devices are disposed is partially coated with a reflective material.

Still another one of the broader forms of the present disclosure involves a lighting module. The lighting module includes: a photonic device that generates light; a thermally-conductive printed circuit board (PCB) on which the photonic device is located; a diffuser cap having a curved profile covering the PCB and the photonic device, the diffuser cap having a textured surface for scattering light generated by the photonic device; a thermally conductive cup surrounding the diffuser cap and thermal-conductively coupled to the PCB, the cup having a reflective inner surface that reflects at least a portion of light transmitting through the diffuser cap; and a heat dissipation structure thermally coupled to the cup.

In some embodiments, the cup has greater dimensions in both a horizontal direction and a vertical direction than the diffuser cap.

In some embodiments, the photonic device includes one or more light-emitting diodes.

In some embodiments, the heat dissipation structure is thermally coupled to the cup through the PCB.

DETAILED DESCRIPTION

It is understood that the following disclosure provides many different embodiments, or examples, for implementing different features of various embodiments. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. Moreover, the terms "top," "bottom," "under," "over," and the like are used for convenience and are not meant to limit the scope of embodiments to any particular orientation. Various features may also be arbitrarily drawn in different scales for the sake of simplicity and clarity. In addition, the present disclosure may repeat reference numerals and/or letters in the various examples. This repetition is for the purpose of simplicity and clarity and does not in itself necessarily dictate a relationship between the various embodiments and/or configurations discussed.

Semiconductor devices can be used to make photonic devices, such as light-emitting diode (LED) devices. When turned on, LED devices may emit radiation such as different colors of light in a visible spectrum, as well as radiation with ultraviolet or infrared wavelengths. Compared to traditional light sources (e.g., incandescent light bulbs), lighting instruments using LED devices as light sources offer advantages such as smaller size, lower energy consumption, longer lifetime, variety of available colors, and greater durability and reliability. These advantages, as well as advancements in LED fabrication technologies that have made LED devices cheaper and more robust, have added to the growing popularity of LED-based lighting instruments in recent years.

Nevertheless, existing lighting instruments using LED emitters may face certain shortcomings. One such shortcoming is that the optics designs for conventional LED emitters have not been optimized for light output uniformity or heat dissipation. Inefficient heat dissipation may further degrade light output uniformity. Therefore, conventional LED emitters may suffer from poor performance due to the inadequate optics designs According to various aspects of the present disclosure, described below is a lighting apparatus that substantially improves light output uniformity and heat dissipation compared to traditional LED-based lighting instruments. Referring to FIG. 1, a diagrammatic fragmentary cross-sectional side view of a portion of a lighting instrument 50 is illustrated according to some embodiments of the present disclosure. The lighting instrument 50 includes a plurality of semiconductor photonic dies 100 as light sources. The semiconductor photonic dies 100 are LED dies in the present embodiment, and as such may be referred to as LED dies 100 in the following paragraphs.

The LED dies 100 each include two oppositely doped semiconductor layers. In one embodiment, the oppositely doped semiconductor layers each contain a "III-V" family (or group) compound. In more detail, a III-V family compound contains an element from a "III" family of the periodic table, and another element from a "V" family of the periodic table. For example, the III family elements may include Boron, Aluminum, Gallium, Indium, and Titanium, and the V family elements may include Nitrogen, Phosphorous, Arsenic, Antimony, and Bismuth. In the present embodiment, the oppositely doped semiconductor layers include a p-doped gallium nitride (GaN) material and an n-doped gallium nitride material, respectively. The p-type dopant may include Magnesium (Mg), and the n-type dopant may include Carbon (C) or Silicon (Si).

The LED dies 100 also each include a multiple-quantum well (MQW) layer that is disposed in between the oppositely doped layers. The MQW layer includes alternating (or periodic) layers of active material, such as gallium nitride and indium gallium nitride (InGaN). For example, the MQW layer may include a number of gallium nitride layers and a number of indium gallium nitride layers, wherein the gallium nitride layers and the indium gallium nitride layers are formed in an alternating or periodic manner. In one embodiment, the MQW layer includes ten layers of gallium nitride and ten layers of indium gallium nitride, where an indium gallium nitride layer is formed on a gallium nitride layer, and another gallium nitride layer is formed on the indium gallium nitride layer, and so on and so forth. The light emission efficiency depends on the number of layers of alternating layers and thicknesses.

It is understood that each LED die may also include a pre-strained layer and an electron-blocking layer. The pre-strained layer may be doped and may serve to release strain and reduce a Quantum-Confined Stark Effect (QCSE)—describing the effect of an external electric field upon the light absorption spectrum of a quantum well—in the MQW layer. The electron blocking layer may include a doped aluminum gallium nitride (AlGaN) material, wherein the dopant may include Magnesium. The electron blocking layer helps confine electron-hole carrier recombination to within the MQW layer, which may improve the quantum efficiency of the MQW layer and reduce radiation in undesired bandwidths.

The doped semiconductor layers and the MQW layer may all be formed by an epitaxial growth process known in the art. After the completion of the epitaxial growth process, a p-n junction (or a p-n diode) is created by the disposition of the MQW layer between the doped layers. When an electrical voltage (or electrical charge) is applied to the doped layers, electrical current flows through the LED dies 100, and the MQW layer emits radiation such as light in a visible spectrum. The color of the light emitted by the MQW layer corresponds to the wavelength of the light. The wavelength of the light (and hence the color of the light) may be tuned by varying the composition and structure of the materials that make up the MQW layer. The LED dies 100 may also include electrodes or contacts that allow the LED dies 100 to be electrically coupled to external devices.

In some embodiments, the LED dies 100 each have a phosphor layer coated thereon. The phosphor layer may include either phosphorescent materials and/or fluorescent materials. The phosphor layer may be coated on the surfaces of the LED dies 100 in a concentrated viscous fluid medium (e.g., liquid glue). As the viscous liquid sets or cures, the phosphor material becomes a part of the LED package. In practical LED applications, the phosphor layer may be used to transform the color of the light emitted by an LED dies 100. For example, the phosphor layer can transform a blue light emitted by an LED die 100 into a different wavelength light. By changing the material composition of the phosphor layer, the desired light color emitted by the LED die 100 may be achieved.

It is understood that, although the lighting instrument 50 includes a plurality of LED dies 100 in the embodiment illustrated in FIG. 1, other embodiments of the lighting instrument 50 may include and use a single LED die as its light source.

Still referring to FIG. 1, the LED dies 100 are mounted on a substrate 120. In some embodiments, the substrate 120 includes a Metal Core Printed Circuit Board (MCPCB). The MCPCB includes a metal base that may be made of Aluminum (or an alloy thereof). The MCPCB also includes a thermally conductive but electrically insulating dielectric layer disposed on the metal base. The MCPCB may also include a thin metal layer made of copper that is disposed on the dielectric layer. In alternative embodiments, the substrate 120 may include other suitable thermally conductive structures. The substrate 120 may or may not contain active circuitry and may also be used to establish interconnections.

The substrate 120 has a reflective surface 130 on which the LED dies 100 are mounted. In some embodiments, the reflective surface 130 includes a solder mask film. The reflective surface 130 helps reflect light emitted by the LED dies 100 out of the lighting instrument 50 as part of the light output.

The lighting instrument 50 includes a diffuser cap 150. The diffuser cap 150 provides a cover for the LED dies 100 therebelow. Stated differently, the LED dies 100 are encapsulated by the diffuser cap 150 and the substrate 120 collectively. In some embodiments, the diffuser cap 150 has a curved surface or profile. In some embodiments, the curved surface may substantially follow the contours of a semicircle, so that each beam of light emitted by the LED dies 100 may reach the surface of the diffuser cap 150 at a substantially right incident angle, for example, within a few degrees of 90 degrees. The curved shape of the diffuser cap 150 helps reduce Total Internal Reflection (TIR) of the light emitted by the LED dies 100. Also, it is understood that whatever light reflected by the diffuser cap 150 back toward the LED dies 100 (and therefore toward the surface 130 of the substrate 120) may be reflected back again, since the surface 130 is reflective as discussed above.

The diffuser cap 150 has a textured surface. For example, the textured surface may be roughened, or may contain a plurality of small patterns such as polygons or circles. Such textured surface helps scatter the light emitted by the LED dies 120 so as to make the light distribution more uniform. In more detail, it would be undesirable to have a light output that is very intense (bright) in some directions or spots and weak (dim) in other directions or spots. The textured surface of the diffuser cap 150 allows incident light to be reflected in a plurality of different directions. Consequently, the result is that the light output is less likely to contain spots having varying degrees of brightness—thereby improving light output uniformity.

In some embodiments, the diffuser cap 150 is coated with a diffuser layer containing diffuser particles. For example, the diffuser particles may include a Polymethyl Methacrylate (PMMA) material and may be mixed in a silicone material. The diffuser layer may be spray coated onto an inner side of the diffuser cap 150.

In some embodiments, a space 160 between the LED dies 100 and the diffuser cap 150 is filled by air. In another embodiment, the spacer 160 may be filled by an optical-grade silicone-based adhesive material, also referred to as an optical gel. Phosphor particles may be mixed within the optical gel in that embodiment so as to further diffuse light emitted by the LED dies 100.

Though the illustrated embodiment shows all of the LED dies 100 being encapsulated within a single diffuser cap 150, it is understood that a plurality of diffuser caps may be used in other embodiments. For example, each of the LED dies 100 may be encapsulated within a respective one of the plurality of diffuser caps.

The lighting instrument 50 includes a reflective structure 180. The reflective structure 180 may be mounted on the substrate 120. In some embodiments, the reflective structure is shaped like a cup, and thus it may also be referred to as a reflector cup. The reflective structure encircles or surrounds the LED dies 100 and the diffuser cap 150 in 360 degrees from a top view. From the top view, the reflective structure 180 may have a circular profile, a beehive-like hexagonal profile, or another suitable cellular profile encircling the diffuser cap 150. In some embodiments, the LED dies 100 and the diffuser cap 150 are situated near a bottom portion of the reflective structure 180. Alternatively stated, the top or upper opening of the reflective structure 180 is located above or over the LED dies 100 and the diffuser cap 150.

The reflective structure 180 is operable to reflect light that propagates out of the diffuser cap 150. In some embodiments, the inner surface of reflective structure 180 is coated with a reflective film, such as Aluminum, Silver, or alloys thereof. It is understood that the surface of the sidewalls of the reflective structure 180 may be textured in some embodiments, in a manner similar to the textured surface of the diffuser cap 150. Hence, the reflective structure 180 is operable to perform further scattering of the light emitted by the LED dies 100, which reduces glare of the light output of the lighting instrument 50 and makes the light output friendlier to the human eye.

In some embodiments, the sidewalls of the reflective structure 180 have a sloped or tapered profile. In other words, the reflective structure 180 has a narrower bottom portion (near the LED dies 100) and a wider top portion (through which light emitted by the LED dies 100 propagates outside the lighting instrument 50). The tapered profile of the reflective structure 180 enhances the light reflection efficiency of the reflective structure 180. As an example, one of the LED dies 100 emits a light beam 190A, which travels through the diffuser cap 150 and reaches one of the sidewalls of the reflective structure 180. (For reasons of simplicity, any diffraction of light by the diffuser cap 150 is not shown). Upon reaching the surface of the reflective structure 180, the light 190A becomes reflected as reflected light 190B. The reflected light 190B propagates in a direction away from the LED dies 100 and toward an upper opening of the reflective structure 180, i.e. outside the lighting instrument 50. This kind of light reflection helps increase light output efficiency, since the total amount of light output is not substantially reduced (since light emitted "sideways" still reaches the output of the lighting instrument due to proper reflection).

In some embodiments, the sidewalls of the reflective structure 180 are substantially straight, as shown in FIG. 1. In another embodiment, the sidewalls of the reflective structure 180 may be curved, as shown in the perspective view of FIG. 2, which will be discussed below in more detail. In other embodiments, the sidewalls of the reflective structure 180 may be designed and configured to optimize light reflection according to design needs and manufacturing concerns. The reflective structure 180 may also configured to help dissipate heat, as is discussed later in more detail.

The lighting instrument 50 includes a thermal dissipation structure 200, also referred to as a heat sink 200. The heat sink 200 is thermally coupled to the LED dies 100 (which generate heat during operation) through the substrate 120. In other words, the heat sink 200 is attached to the substrate 120, or the substrate 120 is located on a surface of the heat sink 200. The heat sink 200 is configured to facilitate heat dissipation to the ambient atmosphere. The heat sink 200 contains a thermally conductive material, such as a metal material. The shape and geometries of the heat sink 200 are designed to provide a framework for a familiar light bulb while at the same time spreading or directing heat away from the LED dies 100. To enhance heat transfer, the heat sink 200 may have a plurality of fins 210 that protrude outwardly from a body of the heat sink 200. The fins 210 may have substantial surface area exposed to ambient atmosphere to facilitate heat transfer.

As mentioned above, the reflective structure 180 may be configured to radiate heat as well, thereby effectively serving as a secondary heat sink for dissipating the heat generated by the LED dies. In some embodiments, the reflective structure 180 is implemented with a thermally conductive material and is thermally coupled to the LED dies 100 or suitable LED packaging. In some embodiments, the reflective structure 180 is thermal conductively coupled to the thermally conductive substrate 120 and the heat sink 200, so as to effectively dissipate heat generated by the LED dies 100. For example, the reflective structure 180 may contain a metal material (which is a good thermal conductor) and has a significant attachment interface with the substrate 120 or to the heat sink 200, so as to increase the heat dissipation area. It is also understood that the lighting instrument 50 may include one or more attachment mechanisms 230, which may include a plurality of thermally conductive screws as illustrated herein, to secure the substrate 120, the reflective structure 180, and the heat sink 200 together.

Figure 2:
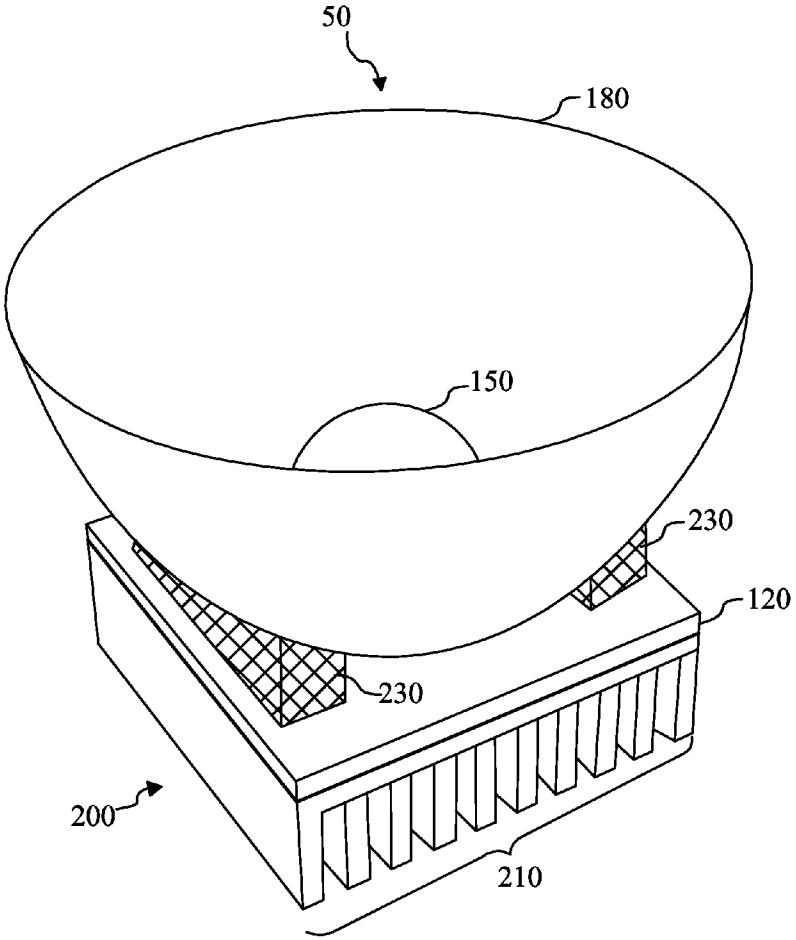
FIG. 2 is a diagrammatic fragmentary perspective view of an example lighting apparatus using a semiconductor photonic device as a light source according to various aspects of the present disclosure.

FIG. 2 illustrates a simplified diagrammatic fragmentary perspective view of a portion of some embodiments of the lighting instrument 50 of FIG. 1. For purposes of consistency and clarity, the same or similar components appearing in both FIGS. 1 and 2 are labeled the same in herein.

The LED dies 100 (not visible in FIG. 2) are located on the substrate 120. The substrate 120 includes a Metal Core Printed Circuit Board in the illustrated embodiment. The LED dies 100 are encapsulated under the diffuser cap 150. As discussed above with reference to FIG. 1, the diffuser cap 150 has a textured surface to increase the scattering of light emitted by the LED dies, so as to make the light output more uniform and less glaring to the human eye. Also, the diffuser cap 150 has a rounded or curved surface, for example in the shape of a semicircle. Such shape enhances the light output efficiency as well, for example due to close to right incident angles between the surface of the diffuser cap 150 and the light emitted by the LED dies 100.

As FIG. 2 illustrates, the diffuser cap 150 is located near the bottom of the reflective structure 180. In other words, the reflective structure 180 has a greater height (or is taller than) the diffuser cap 150. The reflective structure 180 may have an inner surface made of a reflective material or coated with a reflective film. The inner surface may be textured in some embodiments. The reflective structure 180 has a rounded shape in the illustrated embodiment, which may resemble a cup or a bowl. The sidewall of the reflective structure 180 is also tapered and curved in the illustrated embodiment, thereby enhancing light reflection as well.

During the operation of the lighting instrument, light traveling outside the diffuser cap 150 toward the sidewall of the reflective structure 180 can be reflected up toward the upper opening of the reflective structure 180. In some cases, depending on the angle of the incident light, the reflected light may hit an opposite sidewall of the reflective structure 180 and be reflected again. This process may repeat several times before the light propagates out of the upper opening of the reflective structure 180. Regardless, the relative configuration between the reflective structure 180 and the diffuser cap 150 ensures that light is not lost or wasted, and that a total amount light output of the lighting instrument 50 can be maintained or at least not significantly reduced.

The reflective structure 180 and the diffuser cap 150 located therein are secured to the thermally conductive substrate 120 through the attachment mechanisms 230. The attachment mechanisms 230 contain a thermally conductive material to facilitate the dissipation of thermal energy. The attachment mechanism 230 may also include thermally conductive (e.g., metal) screws for mechanical attachment purposes.

The substrate 120 is attached to the heat sink 200 (for example through the screws of the attachment mechanism 230). The heat sink 200 contains a thermally conductive material to facilitate the dissipation of thermal energy. The fins 210 improve the heat transfer capabilities of the heat sink 200. Also, as discussed above, since the reflective structure 180 is thermally coupled to the LED dies 100 and to the heat sink 200, the reflective structure 180 may be utilized to carry out heat dissipation as well, in addition to reflecting light.

Figure 3:
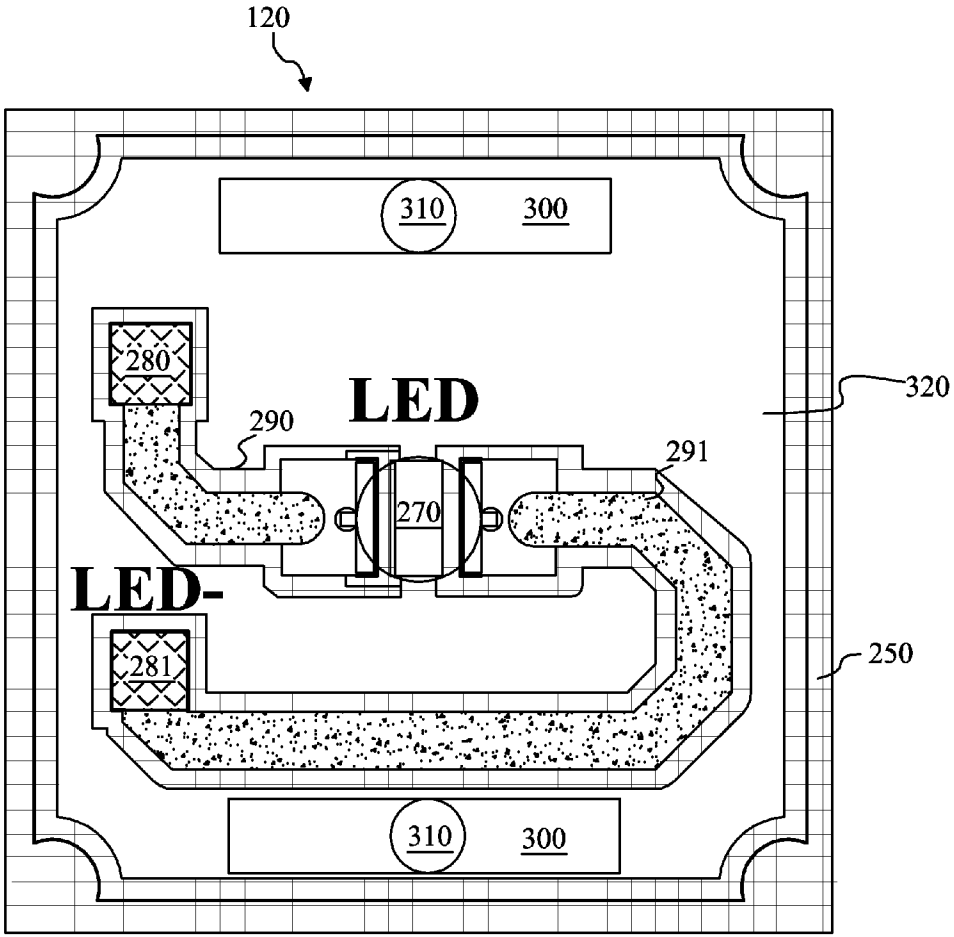
FIG. 3 is a diagrammatic fragmentary top view of a thermally conductive substrate according to various aspects of the present disclosure.

FIG. 3 illustrates a simplified diagrammatic fragmentary top view of a portion of the substrate 120 according to some embodiments. In the illustrated embodiment, the substrate 120 includes an MCPCB. As discussed above, the MCPCB includes a metal core (which may be Aluminum-based), a thermally conductive dielectric layer, and a metal surface (which may be Copper-based) 250. The metal surface 250 is shown herein in the top view. The MCPCB also includes an LED thermal pad 270, on which one of the LED dies 100 (FIG. 1) is mounted. It is understood that although only a single LED thermal pad 270 is shown, the MCPCB may include a plurality of other unillustrated LED thermal pads, each of which is thermally and electrically conductive. The positive and negative polarities of the LED die 100 are accessed by contact pads 280 and 281, respectively, which are coupled to the LED die 100 by electrical traces 290 and 291, respectively.

The MCPCB also includes metal cladding (e.g., copper cladding) regions 300, which may constitute the attachment interface areas between the MCPCB and the attachment mechanism 230 of FIG. 2. The metal cladding regions 300 have good thermal conductivity. To further enhance the thermal conductivity, a Thermal Interface Material (TIM) may be applied on the metal cladding regions 300. For example, the TIM material may include a thermally conductive glue, a thermally conductive gel, a thermally conductive tape, or a suitable metal-based product. A screw hole 310 is also located inside each copper cladding region 300 in the illustrated embodiment, which is reserved for the penetration of screws that attach the diffuser cap 150 above to the heat sink 200 below. Thermal energy generated by the LED dies 100 during their operation can be efficiently transfer to the heat sink 200 or to the diffuser cap 150 through the thermally conductive substrate 120.

Some areas of the metal surface 250 of the MCPCB are covered by a light-reflective film, which includes a solder mask film 320 in the illustrated embodiment. The solder mask film 300 is operable to reflect light emitted by the LED dies 100, thereby increasing light output efficiency.

The lighting instrument 50 according to the embodiments disclosed herein offers advantages over existing semiconductor-based lighting products. It is understood, however, that not all advantages are necessarily discussed herein, and different embodiments may offer additional advantages, and that no particular advantage is necessarily required for all embodiments.

One advantage of the embodiments disclosed herein is that, by implementing the reflective structure 180 "outside" the diffuser cap 150, performance of the lighting instrument 50 is improved. In more detail, conventional LED lamps may employ a cap structure (often flat) that covers a reflector cup structure. An LED light sources is housed therein. In doing so, conventional LED lamps may not be as efficient, since the cap structure may cause some light beams emitted by the LED light sources to be reflected back toward the LED light sources, thereby diminishing the total amount of light output. In comparison, the embodiments disclosed herein implement a reflective structure located outside (and surrounds) the diffuser cap. The light emitted by the LED dies achieves good uniformity through the optical design mechanisms of the diffuser cap (e.g., textured surface, curved shape, etc). In addition, once light propagates outside the diffuser cap, any light reflected by the reflective structure will be redirected towards the output of the lighting instrument, as opposed to back towards the LED dies (or the diffuser cap). As such, waste of light is substantially prevented, and the configuration of the reflective structure relative to the diffuser cap improves the efficiency of the lighting instrument according to the embodiments disclosed herein.

Another advantage of the embodiments disclosed herein is that the diffuser cap herein may be designed to have a suitable curved shape such that the light emitted by the LED dies form substantially right angles with the surface of the diffuser cap. Compared to traditional cap structures having a flat or straight surface, the curved shape of the diffuser cap herein reduces the possibility of Total Internal Reflection and maximizes light transfer from the LED dies to outside the diffuser cap.

Yet another advantage of the embodiments disclosed herein is that the reflective structure disclosed herein may be designed to have a suitable curved shape to ensure that light propagating from the diffuser cap will be reflected toward the output of the lighting instrument, rather than back toward the diffuser cap. For example, this may be accomplished by designing the reflective structure to have a tapered profile, where an upper portion (i.e., further away from the diffuser cap) of the reflective structure is wider than a lower portion (i.e., closer to the diffuser cap) of the reflective structure. This type of configuration minimizes light reflection away from the output of the lighting instrument. In some embodiments, a specific desired output light pattern may be achieved by proper configuration of the shape and surface materials of the reflective structure.

A further advantage is that the reflective structure may be used to dissipate heat generated by the LED dies, thereby serving as an additional heat sink. The reflective structure is thermally coupled to the LED dies and to the heat sink. As such, the reflective structure is operable to transfer heat generated by the LED dies. The fact that the reflective structure is located outside the diffuser cap means that the heat dissipated by the reflective structure will not be trapped within the lighting instrument by the diffuser cap. Hence, heat can be dissipated more efficiently and causes less damage to the LED dies herein.

Yet an additional advantage of the embodiments disclosed herein is the integration flexibility. For example, a single reflective structure may be implemented for just one LED die, or for a plurality of LED dies. Each LED die may be encapsulated within its own diffuser cap, or alternatively all the LED dies may be encapsulated within a single diffuser cap. In embodiments where a single reflective structure and a single diffuser cap is used (as illustrated in FIGS. 1-2), the cost of fabrication may also be reduced. It is also noted that it may be easier to manufacture and install a relatively small diffuser cap over one or more LED devices and then installing a reflective structure outside the diffuser cap, than installing a cap over a reflector cup (as is done in many conventional LED lamps).

Figure 4:
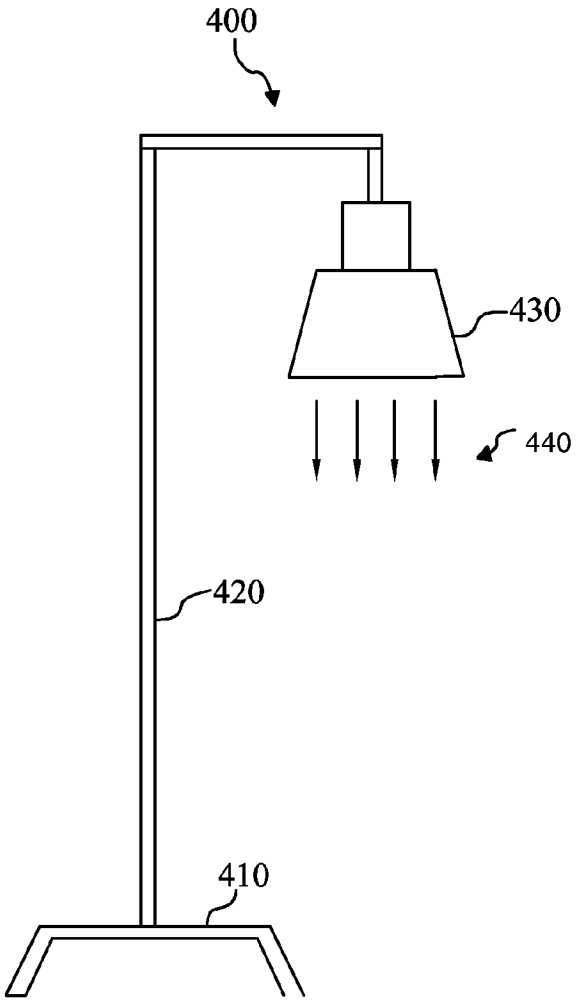
FIG. 4 is a diagrammatic view of a lighting module that includes a photonic lighting apparatus of FIGS. 1 and 2 according to various aspects of the present disclosure.

FIG. 4 illustrates a simplified diagrammatic view of a lighting module 400 that includes some embodiments of the lighting instrument 50 discussed above. The lighting module 400 has a base 410, a body 420 attached to the base 410, and a lamp 430 attached to the body 420. In some embodiments, the lamp 430 is a down lamp (or a down light lighting module).

The lamp 430 includes the lighting instrument 50 discussed above with reference to FIGS. 1-2. In other words, the lamp 430 of the lighting module 400 includes an LED-based light source, a diffuser cap that encapsulate the LED light source therein, a reflective structure that is implemented outside the diffuser cap and surrounds the diffuser cap, and a heat sink that dissipates the heat generated by the LED light source. Due at least in part to the advantages discussed above, the lamp 430 is operable to efficiently project light beams 440 that have superior uniformity less glare compared to light projected by traditional LED lamps. In addition, because of the improved heat dissipation capabilities, the lamp 430 can offer greater durability and longer lifetime compared to traditional LED lamps.

Figure 5:
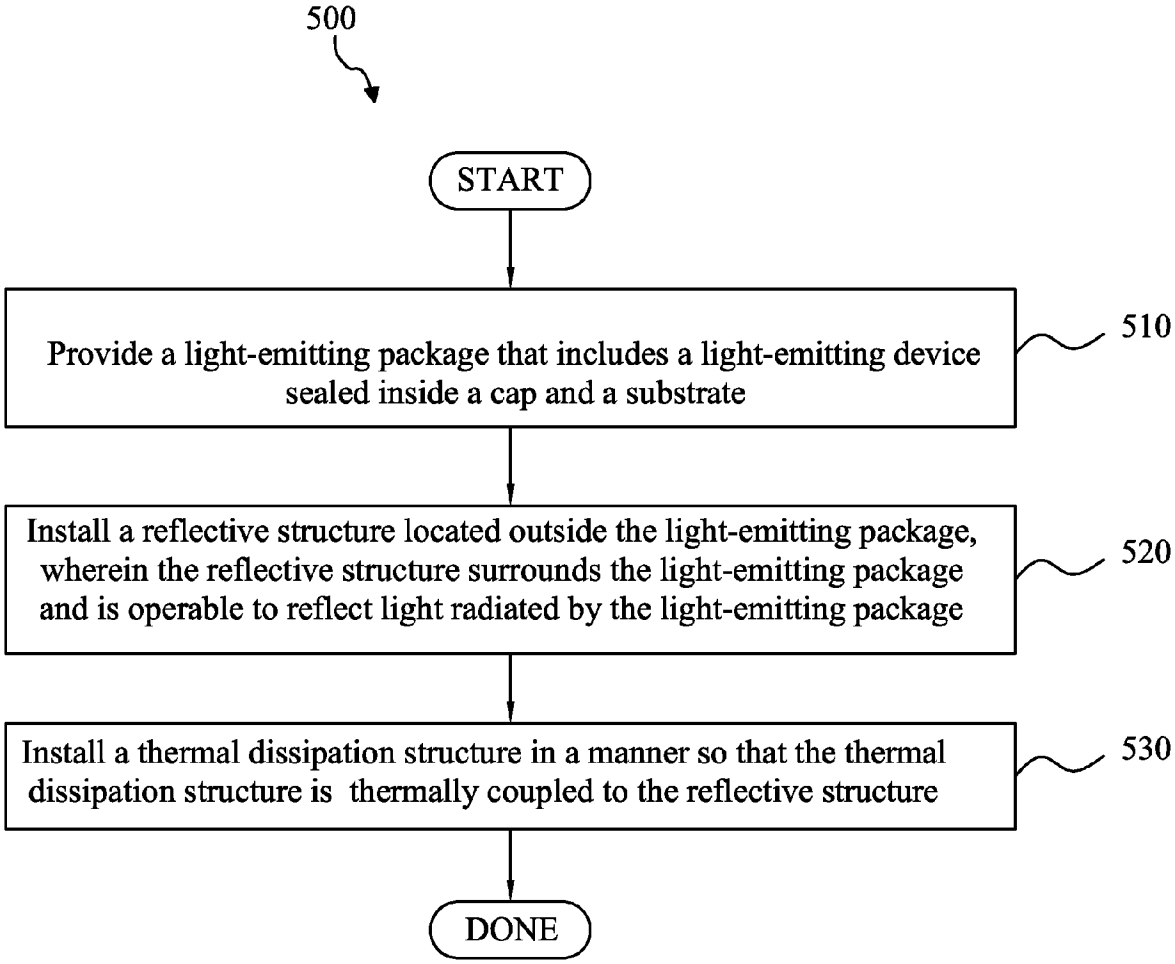
FIG. 5 is a flowchart illustrating a method of fabricating a lighting apparatus using a semiconductor photonic device as a light source according to various aspects of the present disclosure.

FIG. 5 is a flowchart of a method 500 for fabricating a lighting apparatus using a semiconductor photonic device as a light source according to various aspects of the present disclosure. The method 500 includes block 510, in which a light-emitting package is provided. The light-emitting package includes one or more light-emitting devices sealed inside a cap and a substrate. The light-emitting devices may be LED dies. The cap may be a diffuser cap for scattering light, which may have a textured surface and a curved shape. In some embodiments, the light-emitting device is located over the substrate, and a surface of the substrate over which the light-emitting device is located is operable to reflect light. In some embodiments, the substrate includes a Metal Core Printed Circuit Board.

The method 500 includes block 520, in which a reflective structure is installed. The reflective structure is located outside the light-emitting package. The reflective structure surrounds the light-emitting package and is operable to reflect light radiated by the light-emitting package. In some embodiments, the reflective structure encircles the light-emitting package by 360 degrees. In some embodiments, the reflective structure includes a reflector cup having a sloped sidewall profile. In some embodiments, the reflective structure is thermally conductive and is thermally coupled to the light-emitting package.

The method 500 includes block 530, in which a thermal dissipation structure is installed to be thermally coupled to the reflective structure. The thermal dissipation structure is thermally coupled to the substrate. In some embodiments, the thermal dissipation structure includes a board and a plurality of fins attached to the board, and the substrate is located on the board. In some embodiments, the light-emitting package, the reflective structure, and the thermal dissipation structure are integrated within the down light lighting module.

It is understood that additional processes may be performed before, during, or after the blocks 510-530 discussed herein to complete the fabrication of the lighting apparatus.

The foregoing has outlined features of several embodiments so that those skilled in the art may better understand the detailed description that follows. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

What is claimed is:

1. A lighting instrument, comprising:

a substrate;

a heat sink thermal-conductively coupled to the substrate;

one or more light-emitting devices disposed over the substrate;

a diffuser cap disposed over the substrate, wherein the diffuser cap houses the one or more light-emitting devices therein, wherein the diffuser cap has a textured surface; and a reflective structure disposed over the substrate and thermal-conductively coupled to the heat sink, wherein the reflective structure circumferentially surrounds the one or more light-emitting devices.

2. The lighting instrument of claim 1, wherein the reflective structure contains a metal material.

3. The lighting instrument of claim 1, wherein the reflective structure has a tapered cross-sectional profile.

4. The lighting instrument of claim 1, wherein the reflective structure has a round top view profile.

5. The lighting instrument of claim 1, wherein the reflective structure has beehive-like top view profile.

6. The lighting instrument of claim 1, wherein the reflective structure has a textured surface.

7. The lighting instrument of claim 1, wherein a surface of the substrate over which the one or more light-emitting devices are disposed is light-reflective.

8. The lighting instrument of claim 1, wherein the substrate includes a printed circuit board (PCB).

9. The lighting instrument of claim 1, wherein the heat sink and the reflective structure are disposed on opposite sides of the substrate.

10. A lighting instrument, comprising:

a substrate having a first side and a second side opposite the first side;

a heat sink thermal-conductively coupled to the substrate through the first side;

one or more light-emitting devices disposed over the second side of the substrate;

a diffuser cap disposed over the second side of the substrate, wherein the one or more light-emitting devices are housed within the diffuser cap, wherein the diffuser cap has a textured surface; and a light-reflective structure disposed over the second side of the substrate, wherein the light-reflective structure contains a thermally conductive material and is thermal-conductively coupled to the heat sink, and wherein the light-reflective structure encircles the diffuser cap.

11. The lighting instrument of claim 10, wherein the light-reflective structure has sloped sidewalls.

12. The lighting instrument of claim 10, wherein the light-reflective structure has one of: a circular top view profile or a hexagonal top view profile.

13. The lighting instrument of claim 10, wherein the reflective structure has a textured surface.

14. The lighting instrument of claim 10, wherein a surface on the second side of the substrate is light-reflective.

15. The lighting instrument of claim 10, wherein the substrate includes a printed circuit board (PCB).

16. A lighting instrument, comprising:

a substrate having a first surface and a second surface opposite the first surface, wherein the second surface is light-reflective;

a thermal dissipation structure thermal-conductively coupled to the first surface of the substrate;

a light-emitting package disposed over the second surface of the substrate, wherein the light-emitting package contains one or more light-emitting diodes (LEDs);

a diffuser cap disposed over the second surface of the substrate and housing the light-emitting package therein, wherein the diffuser cap has a textured surface; and a reflector cup thermal-conductively coupled to the thermal dissipation structure and encircling the light-emitting package, wherein the reflector cup has a textured inner surface configured to reflect and scatter light emitted by the LEDs.

17. The lighting instrument of claim 16, wherein the reflector cup has a tapered or curved cross-sectional profile and a round or hexagonal top view profile.

* * * * *